United States Patent [19]

Russel et al.

[11] Patent Number: 4,930,765

[45] Date of Patent: Jun. 5, 1990

[54] SHEET COLLECTION MECHANISM FOR STACKING LONG AND SHORT SHEETS

[75] Inventors: Steven M. Russel, Pittsford; James A. McGlen, Rochester; Erik V. Anderson, Fairport, all of N.Y.

[73] Assignee: Eastman Kodak Company, Rochester, N.Y.

[21] Appl. No.: 290,329

[22] Filed: Dec. 27, 1988

[51] Int. Cl.[5] ..... B65H 31/04

[52] U.S. Cl. ..... 271/214; 271/207; 271/209; 271/213; 271/223; 271/224

[58] Field of Search ..... 271/189, 207, 213, 214, 271/220, 223, 209, 224

[56] References Cited

U.S. PATENT DOCUMENTS

| | | | |
|---|---|---|---|
| 3,814,415 | 6/1974 | Hunter et al. | 271/214 X |
| 4,405,125 | 9/1983 | Kulpa et al. | 271/224 X |

FOREIGN PATENT DOCUMENTS

| | | | |
|---|---|---|---|
| 0052142 | 3/1983 | Japan | 271/213 |
| 0104866 | 6/1983 | Japan | 271/213 |
| 0002566 | 1/1985 | Japan | 271/224 |
| 0002624 | 1/1986 | Japan | 271/147 |
| 0244865 | 10/1987 | Japan | 271/224 |
| 0255347 | 11/1987 | Japan | 271/213 |

OTHER PUBLICATIONS

Colglazier, "Variable Size Exit Tray", 12-1975, IBM Technical Disclosure, vol. 18, No. 7.

Hammond, "Copier Exit Tray", 11-1977, IBM Technical Disclosure, vol. 20, No. 6.

*Primary Examiner*—Joseph J. Rolla

*Assistant Examiner*—Boris Milef

*Attorney, Agent, or Firm*—Leonard W. Treash

[57] ABSTRACT

A sheet collection mechanism includes three tray portions defining a slanted receiving surface. The surface extends from a lower stop against which sheets are stacked upward to a position below an egress for sheets and is long enough to stack long sheets without interference between the leading edge of an egressing sheet and the stack. To stack shorter sheets the downstream edges of two upper tray portions are selectively raiseable to cause the leading edge of a sheet to engage the stack downstream of the stacks' trailing edge. An auxiliary drive roller is positioned to cooperate with the downstream part of one of the upper trays when raised to assist in driving short sheets to the stop.

8 Claims, 4 Drawing Sheets

SHEET COLLECTION MECHANISM FOR STACKING LONG AND SHORT SHEETS

TECHNICAL FIELD

This invention relates to a sheet collection mechanism for receiving and stacking a plurality of sheets, which mechanism is adjustable to receive and stack both long and short sheets.

BACKGROUND ART

Apparatus whose output is a stack of sheets, for example, copiers and printers, commonly have the capability of providing that output in a variety of sizes. For example, modern copiers, copy onto ledger-sized sheets and feed those sheets longitudinally through a path which makes their in-track dimension approximately 17 inches. These same copiers feed letter-size sheets with the long dimension positioned across the path which makes their in-track dimension 8 ½ inches. If letter-size sheets are fed into the usual downwardly slanted collection tray from an upper exit, and if that collection tray is long enough for ledger size sheets, the leading edge of such a letter-size sheet will engage the trailing edge of the stack and not slide down onto the top of the stack.

This problem has been corrected in the prior art by a number of mechanisms. For example, the exit from the paper path can be positioned at the bottom of the tray and sheets fed up the tray. Similarly, the tray itself can be made adjustable either manually or automatically by movement of a stop either up or down the receiving surface.

All geometries do not lend themselves to these solutions. For example, if the stack is being collected for finishing such as stapling, machine geometry may require the staple in the leading edge of the stack. In a bottom feed stacking arrangement, the trailing edge collects against a registration stop and the leading edge is up the tray at a location which varies according to sheet size. Either the stack or stapler must be movable to accommodate this geometry. Moving an unstapled stack is a difficult task.

DISCLOSURE OF THE INVENTION

It is an object of the invention to provide a sheet collection mechanism for receiving and stacking a plurality of sheets, which mechanism is adjustable to receive and stack both long and short sheets and which does not require an adjustable stop or a bottom exit.

This and other objects are accomplished by a mechanism having a receiving surface long enough to receive and support long sheets which receiving surface has upstream and downstream portions. The downstream edge of the upstream portion is displaceable from the upstream edge of the downstream portion to cause the leading edge of a short sheet to engage a stack of short sheets at a position downstream of the trailing edge of the stack.

According to a preferred embodiment a sheet drive means is positioned generally above the downstream edge of the upstream portion and cooperates with such downstream edge to drive short sheets toward the stack when the upstream portion is in its displaced position.

According to a further preferred embodiment the upstream portion further includes an upstream tray part the downstream portion of which is raiseable separately from the rest of the upstream portion to stack intermediate size sheets.

With this structure, particular geometries of apparatus which require top feeding of sheets to an inclined tray having a non-adjustable stop can still be made to accommodate sheets of greatly varying in-track dimension.

BEST MODE OF CARRYING OUT THE INVENTION

Figure 1:
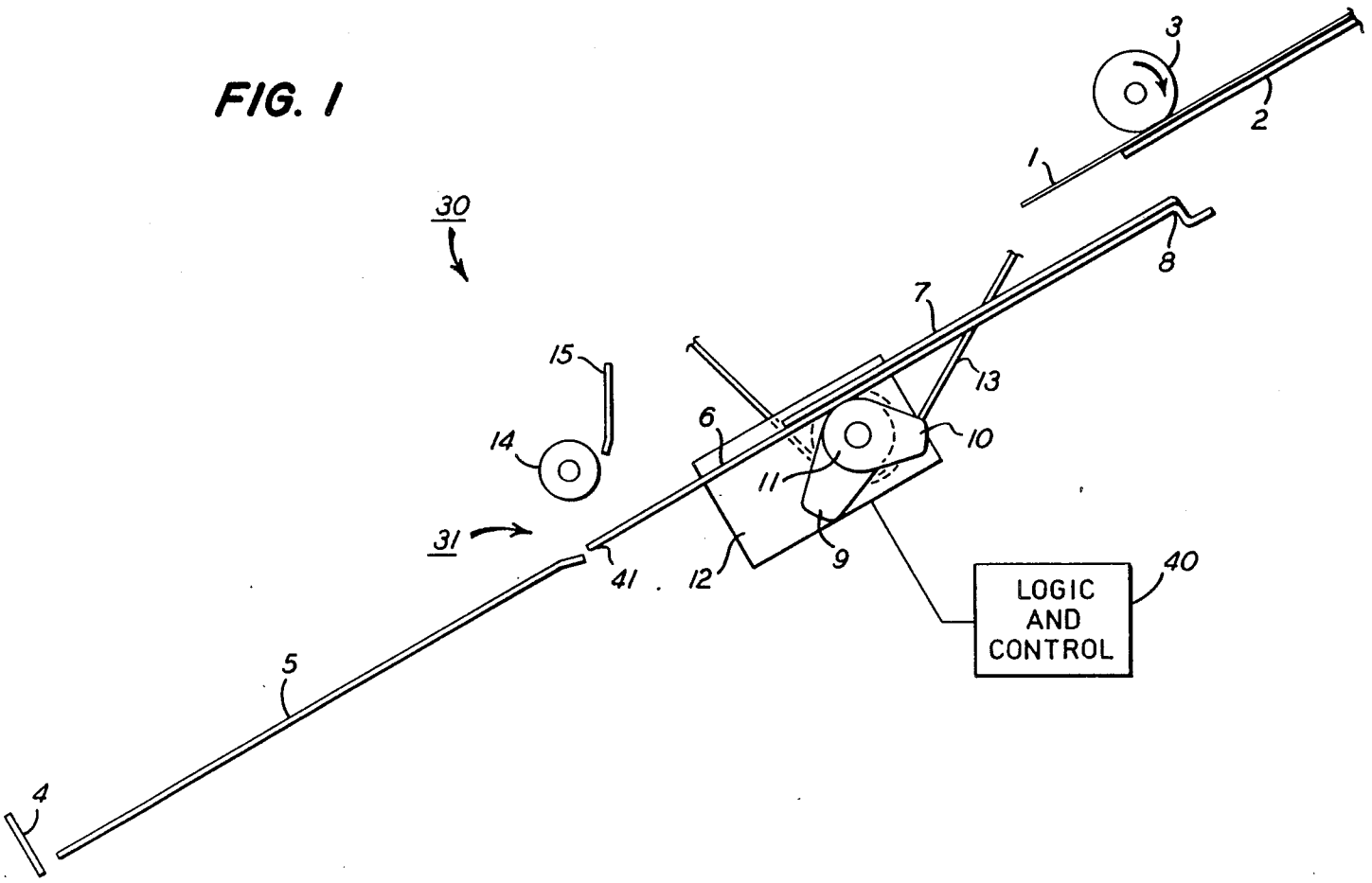
FIG. 1 is a side schematic view of a sheet receiving mechanism constructed according to the invention with a single long sheet being fed and no sheets yet stacked therein.

According to FIG. 1 a sheet collection mechanism 30 is positioned to receive and stack sheets received from an egress from an exit path of reproduction apparatus such as a copier or printer. The path is defined in part by a sheet support 2 and a transport roller 3, shown in FIG. 1 feeding a sheet 1 to the mechanism 30.

The sheet collection mechanism 30 has a slanted receiving surface 31 which is defined by the upper surfaces of tray portions 5, 6 and 7. The leading edge of a sheet 1 exiting the path defined by members 2 and 3 droops to the slanted receiving surface 31 and when released by members 2 and 3 slides to the bottom of surface 31 where its leading edge engages a stop 4. The egress from the exit path is positioned above the top end of slanted receiving surface 31. The distance between stop 4 and roller 3 is such that the trail edge of a 17 inch sheet will exit the roller before the lead edge reaches the stop.

Figure 2:
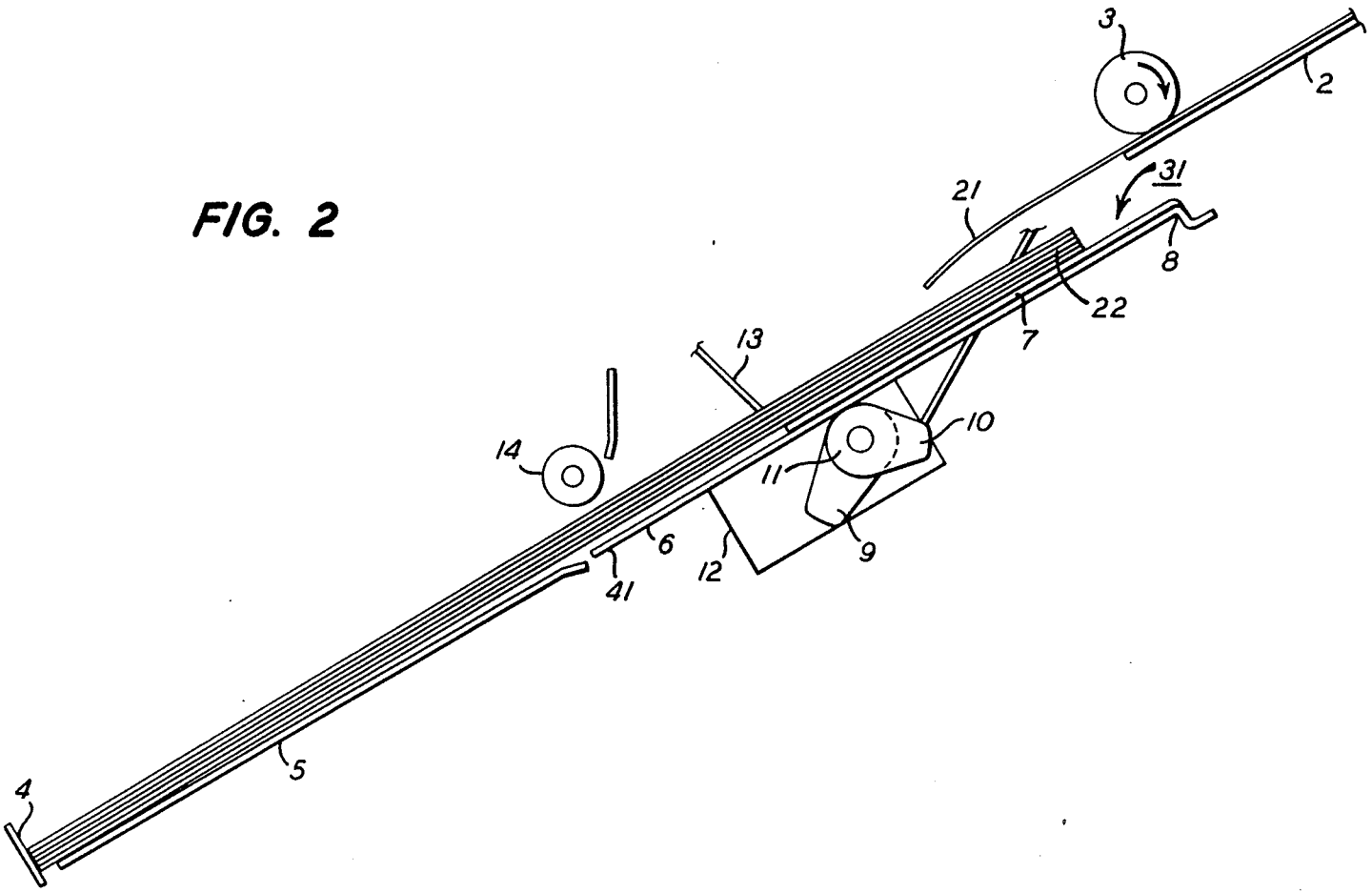
FIGS. 2, 3 and 4 are side schematic views similar to FIG. 1 illustrating the apparatus shown in FIG. 1 in each of three modes of operation.

As seen in FIG. 2, the distance between the stop 4 and the leading edge of the next sheet 21 as it droops toward the surface 31 is such that for long sheets the leading edge of the second and subsequent sheets first touches the preceding sheets or the stack 22 at a position downstream of the trailing edge of the stack. However, if substantially shorter Sheets were to be fed with this apparatus as shown in FIG. 1 or 2, the leading edge of subsequent sheets would be prevented from engaging stop 4 by the trailing edge of the stack. This will cause the formation of 2 stacks on the tray and misalignment of the sheets. If the sheets are of an intermediate length, it can cause jamming of the exit path of the apparatus.

Figure 3:
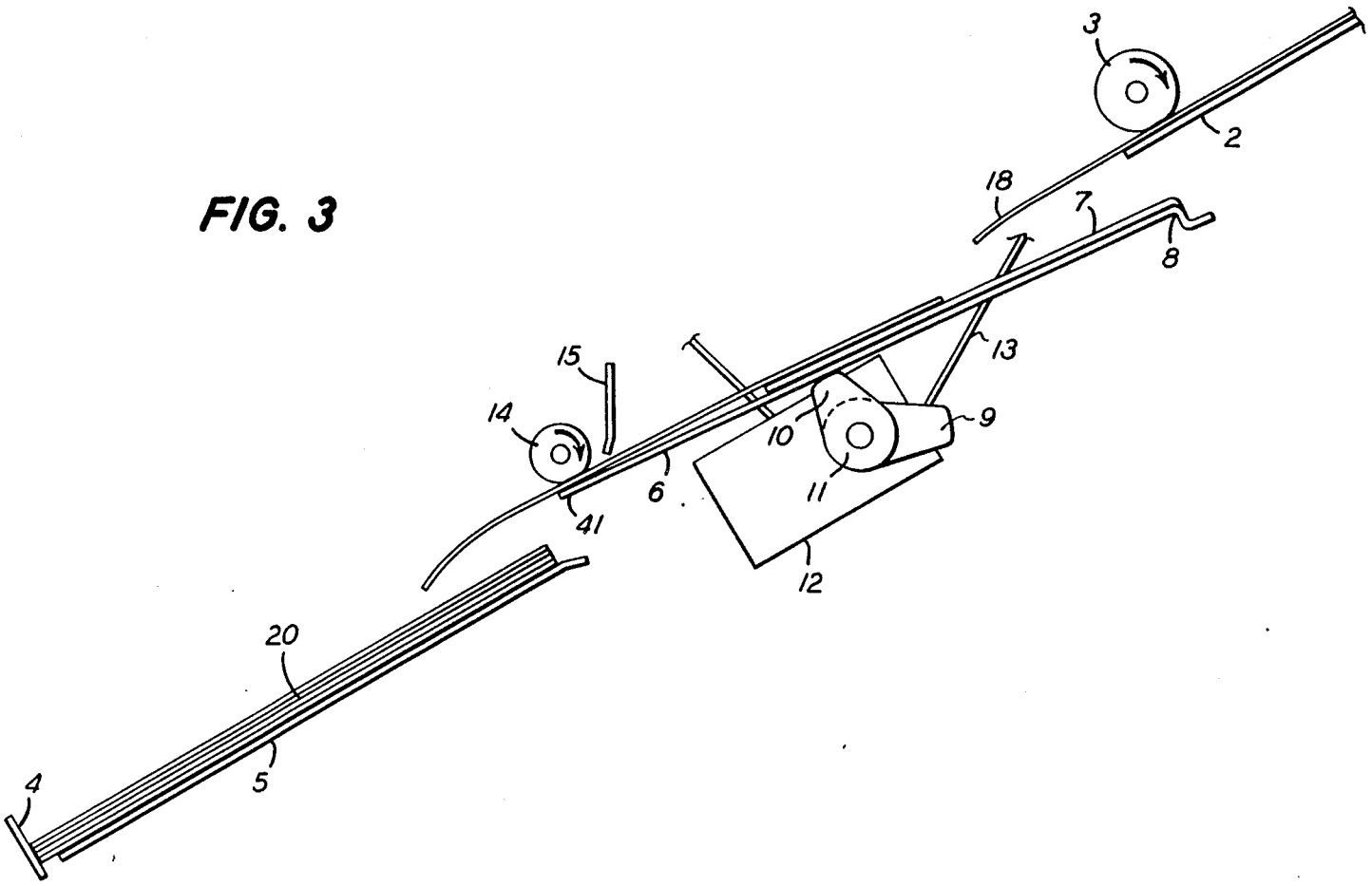

According to FIG. 3, to adapt the sheet collecting mechanism 30 to receive shorter sheets, slanted receiving surface 31 is divided into tray portions 5 and 6. Lower or downstream tray portion 5 is stationary. Upper or upstream tray portion 6 extends from the upstream edge of lower tray portion 5 to a position under the egress of the exit path. The tray portion 6 is pivotable about a pivot point 8 at its upper end so that the downstream or lower edge 41 of upper tray portion 6 can be raised into driving relation with a sheet drive means 14. Short sheets 18, for example, sheets having an in-track dimension of 8 ½ inches, leave the exit path of the apparatus and are pushed by roller 3 until they engage roller 14. Roller 14 is driven by suitable means, for example, the same drive means driving roller 3, to drive sheet 18 onto a short sheet stack 20. Because the downstream edge 41 of upstream portion 6 has been raised above the stack 20, the leading edge of short sheet 18 first engages the top of the stack 20 at a position downstream from the trailing edge of the stack. A guide 15 prevents short sheets from missing the nip between drive roller 14 and tray portion 6. As in the FIG. 2 mode, the short sheets leave roller 14 prior to engaging stop 4.

Figure 4:
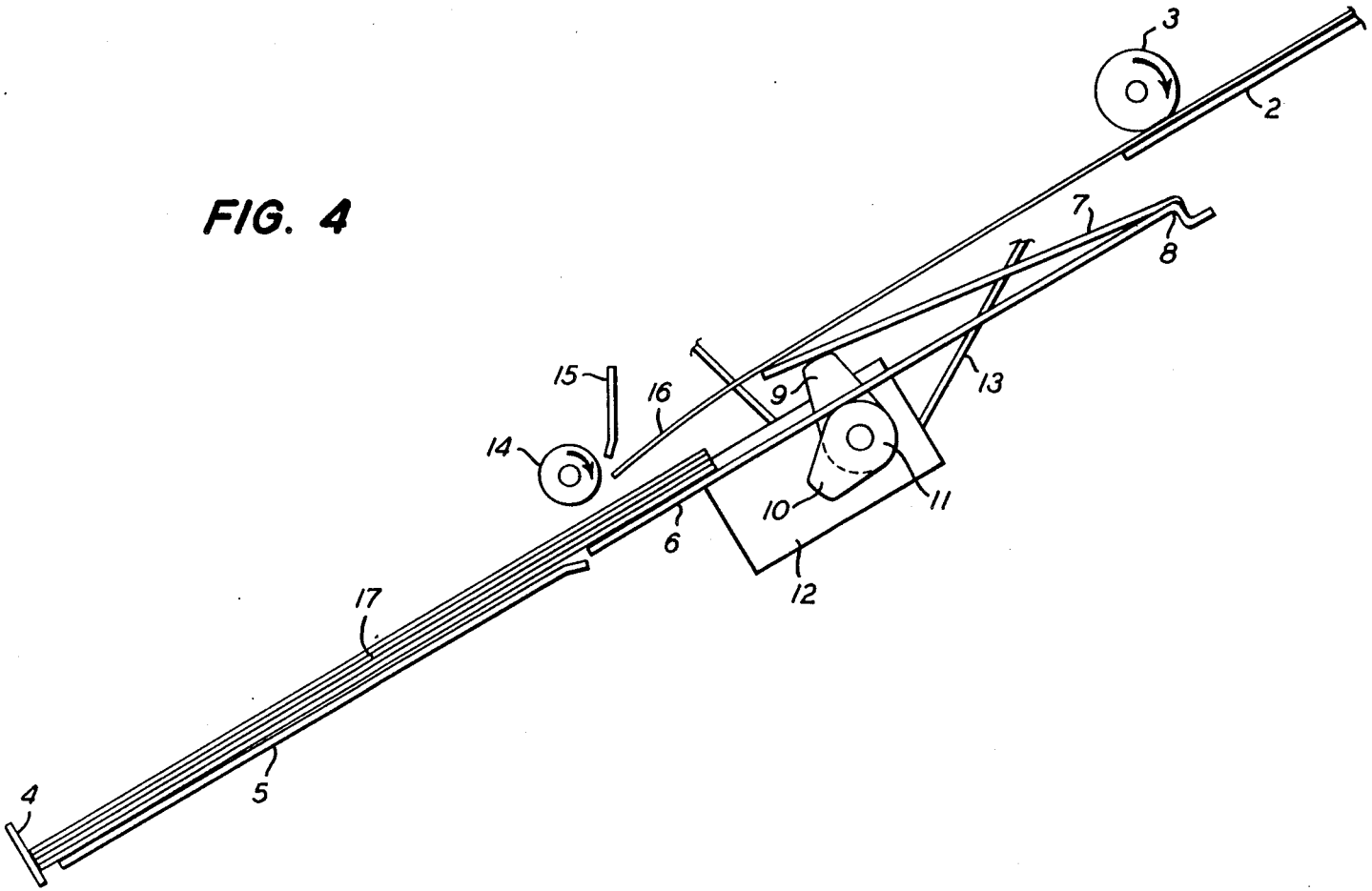

According to FIG. 4, to handle sheets of intermediate length, the upstream tray portion is actually made up of tray portions 6 and 7, both of which are pivoted about a single point 8 at their upper ends. Tray portion 7 rests on top of and is shorter than tray portion 6. Its leading edge is raiseable independently of tray portion 6. An intermediate length sheet 16 is fed first onto tray portion 7 by exit path drive roller 3. Because the leading edge of tray portion 7 has been raised the leading edge of sheet 16 engages intermediate stack 17 at a position downstream from the trailing edge of the stack. Because the sheets of intermediate length are long enough to reach a point where the sheet will slide the rest of the distance to stop 4 when disengaged from the exit transport roller 3, no additional drive roller is necessary. Whether or not an additional drive is necessary is dependent upon the parameters of the system including the angle of the tray, the type of paper used and other mechanisms such as active jogging mechanisms that may affect the tendency of the sheets to move to stop 4.

A 3-position cam means 11 controls the positions of trays 6 and 7 shown in FIGS. 2, 3 and 4. According to FIG. 4, the cam means 11 is positioned directly below trays 6 and 7 and contains an intermediate sheet cam surface 9 which, when positioned vertically, projects through an opening in tray portion 6 to engage and raise tray portion 7 to the position shown in FIG. 4. According to FIG. 3, cam means 11 further includes a short sheet cam surface 10 which is offset from the opening in tray 6, and which when positioned in a vertical position engages tray 6, to raise tray 6 to the position shown. When neither cam surface is in a vertical position the trays are in position to receive long sheets as shown in FIGS. 1 and 2.

As shown schematically in FIG. 1 cam means 11 can be controlled by a one-third revolution clutch 12 powered by a drive belt 13. The clutch 12 includes appropriate control electronics and receives one or more signals from a logic and control 40 for the apparatus indicative of the size of sheet being advanced through the exit paths of the apparatus and actuates cam means 11 accordingly. For example, if the signal from logic and control 40 indicates that there are short sheets in the exit path, clutch 12 will actuate cam 11 to position cam surface 10 vertically to raise the downstream edge of tray portion 6.

The invention can be used for a variety of sizes of sheets. For example, with tray 6 lowered and tray 7 raised as shown in FIG. 4, sheets of intermediate length, for example, 10 inches to 14 inches in in-track dimension can be stacked. With both trays 6 and 7 raised as shown in FIG. 3 the sheet collection mechanism 30 can accept sheets in length from approximately 7 inches to 9 inches. Similarly, with both pivoting trays lowered the mechanism will accept sheets ranging in length from 15 to 17 inches as shown in FIG. 2. The actual size of the sheets that are acceptable in each mode is dependent in part on the stiffness of the sheets as well as the in-track dimension of the trays. Obviously, in-track dimensions of the trays can be picked so that all sheet sizes between say 7 inches and 17 inches can be accommodated.

With the invention, the stack always registers along the same in-track registration edge, stop 4, which allows easy design of finishing apparatus or the like and eliminates the need for auxiliary paper paths or extra registration gates.

The invention has been described in detail with particular reference to a preferred embodiment thereof, but it will be understood that variations and modifications can be effected within the spirit and scope of the invention as described hereinabove and as defined in the appended claims.

We claim:

1. A sheet collection mechanism for receiving and stacking in order a plurality of sheets, which mechanism is adjustable to receive and stack long, short and intermediate length sheets, said mechanism comprising means defining a slanted receiving surface long enough to receive and support long sheets and having an upper end and a lower end, a stop at the lower end of the surface for engaging sheets fed to the surface to form a stack extending toward the upper end of the surface, means for feeding sheets to said surface through a path having an egress spaced from and above the upper end of said surface and located such that the leading edge of a long sheet exiting said egress engages a stack of long sheets at a position downstream of the trailing edge of the stack, said receiving surface having upper and lower portions, the downstream edge of the upper portion being raisable from the upstream edge of the lower portion to cause the leading edge of a short sheet to engage a stack of short sheets at a position downstream of the trailing edge of the stack, and said upper portion including an upstream part the downstream edge of which is raisable independent of the rest of the upper portion for stacking intermediate length sheets.

2. The mechanism according to claim 1 wherein said upper portion has an opening, said upstream part is positioned on top of said upper portion and is pivoted about a point approximately at its upper end, and wherein said mechanism includes cam means which is extendable through said opening in said upper portion to engage said upstream part to pivot said upstream part about said pivot to raise its downstream edge.

3. The mechanism according to claim 1 further including means for selectively raising the downstream edge of the upper portion and for raising the downstream edge of the upstream part.

4. The mechanism according to claim 3 wherein said raising means is a three position cam means having a first position in which said downstream edge of the upper portion is raised, a second position in which said upstream part is raised and a third position in which neither said upper portion nor the upstream part is raised.

5. A sheet collection mechanism for receiving and stacking in order a plurality of sheets, which mechanism is adjustable to receive and stack both long and short sheets, said mechanism comprising means defining a slanted receiving surface long enough to receive and support long sheets and having an upper end and a lower end, a stop at the lower end of the surface for engaging sheets fed to the surface to form a stack extending from said stop toward the upper end of the surface, means for feeding sheets to said surface through a path having an egress spaced from and above the upper end of said surface and located such that the leading edge of a long sheet exiting said egress engages a stack of long sheets at a position downstream of the trailing edge of the stack, characterized in that said receiving surface is defined by upper and lower tray portions, a downstream part of the upper tray portion being raisable from the upstream edge of the lower tray portion to cause the leading edge of a short sheet to engage a stack of short sheets at a position downstream of the trailing edge of the stack, and friction sheet drive means located above and cooperable with the downstream part of the upper tray portion when said downstream part is in its raised position to drive short sheets toward said stop..

6. The mechanism according to claim 5 wherein said upper tray portion includes an upstream tray part, the downstream edge of which is raiseable independent of the rest of the upper tray portion for stacking intermediate length sheets.

7. The mechanism according to claim 5 further including means for selectively raising said downstream part.

8. The mechanism according to claim 5 wherein said friction sheet drive means is a drive roller.

* * * * *